US007347264B2

(12) United States Patent
Nguyen

(10) Patent No.: US 7,347,264 B2
(45) Date of Patent: Mar. 25, 2008

(54) METHODS AND COMPOSITIONS FOR WELL COMPLETION IN STEAM BREAKTHROUGH WELLS

(75) Inventor: Philip D. Nguyen, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 155 days.

(21) Appl. No.: 11/454,235

(22) Filed: Jun. 16, 2006

(65) Prior Publication Data

US 2007/0289742 A1 Dec. 20, 2007

(51) Int. Cl.
*E21B 43/24* (2006.01)
*E21B 33/138* (2006.01)
*E21B 43/22* (2006.01)

(52) U.S. Cl. ..... 166/272.3; 166/270.1; 166/279; 166/288; 166/295; 166/300

(58) Field of Classification Search ..... None
See application file for complete search history.

(56) References Cited

U.S. PATENT DOCUMENTS

| | | | | |
|---|---|---|---|---|
| 4,323,124 A | | 4/1982 | Swan | 166/303 |
| 4,427,069 A | | 1/1984 | Fiedman | 166/295 |
| 4,428,427 A | | 1/1984 | Friedman | 166/278 |
| 4,895,207 A | | 1/1990 | Friedman et al. | 166/276 |
| 4,938,287 A | | 7/1990 | Friedman et al. | 166/288 |
| 5,010,953 A | | 4/1991 | Friedman et al. | 166/288 |
| 5,199,490 A | | 4/1993 | Surles et al. | 166/270 |
| 5,240,075 A | | 8/1993 | Burrows et al. | 166/303 |
| 5,522,460 A | * | 6/1996 | Shu | 166/295 |
| 5,551,513 A | | 9/1996 | Surles et al. | 166/278 |
| 6,311,773 B1 | | 11/2001 | Todd et al. | 166/280 |
| 6,632,778 B1 | | 10/2003 | Ayoub et al. | 507/202 |

* cited by examiner

*Primary Examiner*—Zakiya W. Bates
(74) *Attorney, Agent, or Firm*—Robert A. Kent; Crutsinger & Booth

(57) ABSTRACT

Methods of steam flooding for stimulating hydrocarbon production are provided. In general, the methods comprise the steps of: (A) injecting a mutual solvent preflush fluid capable of dissolving oil into the near-wellbore region of at least a portion of a wellbore; (B) injecting an aqueous preflush fluid further comprising a surfactant capable of oil-wetting silica; (C) injecting a treatment fluid into the near-wellbore region, wherein the treatment fluid comprises a curable resin, and wherein: (i) when injected, the curable resin is in an uncured state; and (ii) after being cured, the curable resin is stable up to at least 350° F. (177° C.); and (D) driving steam to break through the near-wellbore region.

27 Claims, No Drawings

METHODS AND COMPOSITIONS FOR WELL COMPLETION IN STEAM BREAKTHROUGH WELLS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

TECHNICAL FIELD

The invention relates to the production of heavy hydrocarbons using steam flood stimulation. More particularly, the inventions relates to the problem of early breakthrough of steam at a production well

BACKGROUND

As is well known, "steam floods" or "steam drives" are commonly used to recover heavy hydrocarbons, e.g. heavy, viscous oil, from subterranean reservoirs. In a typical steam flood, steam is injected through one or more injection wells. The steam flows through the formation towards one or more production wells, which are separate from the injection well(s).

Typically, the temperature of the steam in the average is around 500° F. (260° C.), and can sometimes even be higher than 600° F. (315° C.). The steam heats the heavy hydrocarbons and other formation fluids, thereby lowering the viscosity of the oil, which reduces their resistance to flow. In addition, the steam provides an additional driving force to increase the flow of oil and other formation fluids toward the production well(s) where the fluids can be produced to the surface.

The wells used in steam floods, both the injection wells and the production wells, are completed either "open-hole" or cased hole and then "gravel packed" to control the flow of sand and/or other particulate material from the formation into the wellbore. In a typical gravel pack completion, a sand control screen, slotted liner or the like, is positioned in the wellbore adjacent the injection or production interval and is surrounded by "gravel" which, in turn, is sized to block the flow of formation particulate material therethrough while allowing the flow of fluids between the formation and the screen.

One of the most serious problems encountered in steam floods or drives is the early breakthrough of steam at the production well. The steam tends to dissolve carbonates and silica materials in the rocky material of subterranean formations, which tends to increase the pH of the steam to the range of about 11-13. The high temperature and the high pH of the steam tend to literally dissolve the gravel sand, which in turn creates void spaces within the gravel pack in the annulus around the production well. In many cases, these void spaces become "hot spots" as the least resistant flow paths. Formation fines or sand also tends to produce along with the production which causes erosion and cut through the gravel pack screens. Pulling the screens and re-gravel packing the well are not favorable options.

U.S. Pat. No. 4,323,124 issued Apr. 6, 1982 having for named inventor Philip G. Swan and assigned to Sigma Chemical Corp. describes in the Abstract thereof a method of inhibiting dissolution of the gravel pack and/or erosion of the formation standstone in a well bore subject to water or steam injection. The method includes the addition of a material to the surface of the gravel or formation which is capable of adhering to such surfaces and forming a tenacious water-repellent film. The film is monomolecular and hydrophobic. The active ingredient in the chemical treatment is commercial soybean lecithin. The material is added to the surfaces by injecting a liquid solution of the chemical down the annulus of the well during steaming and/or physically precoating the gravel pack by soaking it in a liquid solution of the chemical.

U.S. Pat. No. 4,427,069 issued Jan. 24, 1984 having for named inventor Robert H. Friedman and assigned to Getty Oil Company describes in the Abstract thereof that methods are provided for selectively consolidating sand grains within a subterranean formation. First an acidic salt catalyst such as $ZnCl_2$ is injected into the subterranean formation, wherein the acidic salt catalyst is adsorbed to the surface of the sand grains. Next a polymerizable resin composition such as furfuryl alcohol oligomer is introduced into the well formation. Polymerization of the resin occurs upon exposure to the elevated well temperatures and contact with the acid salt catalyst adsorbed to the sand grains. The polymerized resin serves to consolidate the surfaces of the sand grains while retaining permeability through the pore spaces. An ester of a weak organic acid is included with the resin compositions to control the extent of a polymerization by consuming the water by-product formed during the polymerization reaction.

U.S. Pat. No. 4,428,427 issued Jan. 31, 1984 having for named inventor Robert H. Friedman and assigned to Getty Oil Company describes in the Abstract thereof that sand or similar material coated with a polymerizable resin and catalyst is suspended in a viscous fluid carrier. Such a composition is useful for introduction into a wellbore to effect gravel packing of washed-out cavities surrounding the wellbore. The viscous fluid carrier serves to maintain a heterogeneous suspension of sand as the composition is flowed down through the wellbore, so as to prevent premature settling of sand into gradient layers and voids. The fluid carrier includes a polymeric thickener and a small concentration of viscosity-enhancing agent, such as a dye. The viscosity-enhancing agent is effective to alter the configuration of polymeric thickener so as to enhance the viscosity imparted thereby. The sand or gravel included in the gravel packing composition is coated with a polymerizable resin and latent catalyst. At formation condition, the resin polymerizes and links together adjacent sand particles thereby forming a permeable consolidated structure which serves to reestablish washed-out cavities surrounding a borehole are disclosed.

U.S. Pat. No. 4,895,207 issued Jan. 23, 1990 having for named inventors Robert H. Friedman and Billy W. Surles and assigned to Texaco, Inc. describes in the Abstract thereof a fluid and method for suspending resin coated sand in order to place the sand adjacent to a production well for the purpose of forming permeable consolidated gravel pack. The fluid contains a viscosifying amount of hydroxyethylcellulose, sufficient fluorescent dye to increase the viscosity of the fluid, sodium chloride, and an acid forming component such as phthalic anhydride or succinic anhydride. As fluid containing the resin coated gravel particles is pumped down the injection string and positioned where it is desired to form the consolidated gravel pack, the acid forming material slowly reacts with water to form an acid, reducing the pH of the fluid, and thereby reducing the viscosity of the carrier fluid which facilitates the resin coated sand grains coning together in order to form the desired gravel pack.

U.S. Pat. No. 4,938,287 issued Jul. 3, 1990 having for named inventors Robert H. Friedman; Billy W. Surles; and Phillip D. Fader and assigned to Texas, Inc. describes in the Abstract thereof methods for selectively consolidating naturally occurring mineral grains such as sand grains within a subterranean formation to form a fluid permeable barrier, which restrains the movement of said particles when oil passes through the barrier. When applied to formations in which at least a portion of the sand grains are coated with a viscous oily residue of crude oil, or where the pore spaces between the sand grains contain excessive quantities of water, either of which interfere with the polymerization of the polymerizable monomer employed for said consolidation, a preflush is utilized which functions both to remove the oily residue from the said grains and to remove water from the pore spaces of the formation adjacent to the wellbore. The preflush is preferably an ester such as ethyl acetate or butyl acetate in an amount sufficient to occupy substantially all of the pore space of the formation into which the polymerizable component employed for sand consolidation are subsequently injected. In one preferred embodiment an acid catalyst such as sulfuric acid is added to the preflush. After injection of the preflush, the sand consolidation fluid usually containing a monomer or oligomer of furfuryl alcohol is injected, either mixed with steam to form a mulitphase treating fluid or injected as a liquid phase into the formation.

U.S. Pat. No. 5,010,953 issued Apr. 30, 1991 having for named inventors Robert H. Friedman and Billy W. Surles and assigned to Texaco, Inc. describes in the Abstract thereof methods for selectively consolidating naturally occurring mineral grains such as sand grains within a subterranean formation to form a fluid permeable barrier, which restrains the movement of sand particles when oil passes through the barrier. A sand consolidation fluid usually containing a monomer or oligomer of furfuryl alcohol is injected, either mixed with steam to form a multiphase treating fluid or injected as a liquid phase into the formation. The fluid contains an acid catalyst and an ester and an effective amount of a swelling polymer to reduce shrinkage of the furfuryl alcohol when it polymerizes in the formation. A preferred swelling polymer is a copolymer of starch and an acrylamides or acrylates.

U.S. Pat. No. 5,199,490 issued Apr. 6, 1993 having for named inventors Billy W. Surles, Philip D. Fader, and Carlos W. Pardo and assigned to Texaco, Inc. describes in the Abstract thereof processes for treating a subterranean formation to improve the permeability distribution by reducing the permeability in high permeability zones, so fluids injected for oil recovery purposes will sweep more uniformly through the formation. The processes involve injecting a polymerizable compound, preferably a monomer or oligomer of furfuryl alcohol, together with a diluent, preferably an ester such as butyl acetate, and a suitable acid catalyst for the formation conditions, generally toluenesulfonic acid. The fluid may be injected in a liquid phase or mixed with steam or non-condensable gas to form an aerosol, which is injected then into the formation prior to the injection of the oil recovery fluid, which may be water, surfactant fluid, polymer fluid, or steam.

U.S. Pat. No. 5,240,075 issued Aug. 31, 1993 having for named inventors Darryl N. Burrows and Paul S. Northrop and assigned to Mobil Oil Co. disclosed in the Abstract thereof a method and apparatus for treating steam which is to be injected into a formation through a gravel pack well completion by preventing dissolution and removal of silica from the gravel pack. The steam is flowed through a treatment vessel which is filled with a silica-containing material, e.g. sand, where it dissolves silica from the sane prior to injection through the gravel pack. Since the treated steam is already substantially saturated with silica, it will not dissolve any substantial amounts of silica from the gravel pack. The treatment vessel can also be heated during treatment, if desired.

U.S. Pat. No. 5,551,513 issued Sep. 3, 1996 having for named inventors Billy W. Surles and Howard L. McKinzie and assigned to Texaco Inc. describes in the Abstract thereof an improvement in a prepacked well screen assembly which includes coating the granular material in the filter medium with a resin system including an oligomer of furfuryl alcohol, a catalyst including an oil soluble, slightly water soluble organic acid, and an ester of a weak organic acid to consume water produced by the polymerization of the resin.

U.S. Pat. No. 6,632,778 issued Oct. 14, 2003 having for named inventors Joseph A. Ayoub, John P. Crawshaw, and Paul W. Way assigned to Schlumberger Technology Corp. describes in the Abstract thereof a fluid that is useful in consolidating a formation without the use of a gravel pack and screen. In particular, the fluid is useful in consolidating heterogeneous formations where the permeability is not uniform over-the total formation thickness, e.g. a formation having at least a first layer and a second layer, wherein the permeability of the first layer is greater than that of the second layer. The fluid comprises at least one of a resin, a curing agent, and a surfactant, wherein the fluid is self-diverting. Optionally, a catalyst or other additives, such as an oil wetting agent, can be used. Fluids of the present invention are self-diverting, i.e. in a formation comprising at least a first layer and a second layer, wherein the first layer has a higher permeability than the second layer, the depth of penetration of the fluid into the second layer will be greater than that predicted from the permeability ratio (the ratio of the permeability of the first layer to that of the second layer). Self-diversion can be achieved by structuring the fluid by incorporation of another phase, either liquid or gas, or by using an additive in the fluid. Also disclosed are methods for using such a fluid to consolidate a formation, especially a heterogeneous formation.

Thus, there is a continuing and long-felt need for solutions to the problem of early breakthrough of steam at a production well.

SUMMARY OF THE INVENTION

According to the invention, a method of steam flooding for stimulating hydrocarbon production. In general, the method comprises the steps of: (A) injecting a mutual solvent preflush fluid capable of dissolving oil into the near-wellbore region of at least a portion of a wellbore; (B) injecting an aqueous preflush fluid further comprising a surfactant capable of oil-wetting silica; (C) injecting a treatment fluid into the near-wellbore region, wherein the treatment fluid comprises a curable resin, and wherein: (i) when injected, the curable resin is in an uncured state; and (ii) after being cured, the curable resin is stable up to at least 350° F. (177° C.); and (D) driving steam to break through the near-wellbore region.

These and other objects, advantages, and aspects of the invention will be apparent to a person of skill in the art upon reading the detailed description of preferred embodiments of the invention.

DETAILED DESCRIPTION OF PREFERRED EMBODIMENTS

As used herein, the words "comprise," "has," and "include" and all grammatical variations thereof are each intended to have an open, non-limiting meaning that does not exclude additional elements or steps.

As used herein, the words "uphole" and "downhole" directions for a wellbore are relative to the direction of the flow of fluid toward the surface, regardless of the vertical or horizontal orientation of the particular section of wellbore.

As used herein, the term "near-wellbore region" means and refers to an annular volume of a subterranean zone penetrated by the wellbore from the outer diameter of the wellbore extending radially outward to at least about 0.2 times the outer diameter of the wellbore. Further, the near-wellbore region is an annular volume of a subterranean zone penetrated by the wellbore from the outer diameter of the wellbore extending radially outward up to about 0.6 times the outer diameter of the wellbore.

The methods according to the present invention will be described by referring to and showing various examples of how the invention can be made and used.

In general, according to the invention a method of steam flooding for stimulating hydrocarbon production. The method comprises the steps of: (A) injecting a mutual solvent preflush fluid capable of dissolving oil into the near-wellbore region of at least a portion of a wellbore; (B) injecting an aqueous preflush fluid further comprising a surfactant capable of oil-wetting silica; (C) injecting a treatment fluid into a near-wellbore region of at least a portion a wellbore, wherein the treatment fluid comprises a curable resin, and wherein: (i) when injected, the curable resin is in an uncured state; and (ii) after being cured, the curable resin is stable up to at least 350° F. (177° C.); and (D) driving steam to break through the near-wellbore region.

The treatment fluid with the resin is adapted to consolidate the formation, especially at the points of contact between the formation materials that define the pore throats of formation sand matrix in the near-wellbore formation, but not to fill, plug, or block the pore throats. Thus, the resin in the liquid treatment fluid preferably adheres to the surface of the formation material or particulate, but has a sufficiently low viscosity such that excess resin material can be easily washed away to avoid blocking the porosity.

Preferably, the amount of the treatment fluid injected into the near-wellbore region is at least sufficient to substantially treat the near-wellbore region of at least about 0.2 times the outer diameter of the wellbore. More preferably, the amount of the treatment fluid injected into the near-wellbore region is at least sufficient to treat the near-wellbore region out to about 0.6 times the outer diameter of the wellbore.

Generally, a treatment fluid according to the present invention generally comprises a furan-based resin. Optionally, other additives may be included, including, but not limited to, a silane coupling agent, a surfactant, a diluent, and the like.

According to the present invention, preferably the curable resin comprises: a furan based resin. More preferably, the furan-based resin comprises: a furfuryl alcohol resin, a mixture of furfuryl alcohol resins and aldehydes, or a mixture of furfuryl alcohol resins and phenolic resins.

The furan-based resin may comprise a variety of resins that further comprise furfuryl alcohol oligomer resin, or a derivative thereof. The furan-based resins used in the treatment fluids of the present invention are capable of enduring temperatures well in excess of 350° F. (177° C.) without degrading. In certain exemplary embodiments, the furan-based resins are capable of enduring temperatures up to about 700° F. (370° C.) without degrading. Suitable furan-based resins include, but are not limited to, furfuryl alcohol resins, mixtures of furfuryl alcohol resins and aldehydes, and a mixture of furfuryl alcohol resins and phenolic resins. One example of a furan-based resin suitable comprises about 25% to about 45% of a furan-furfuraldehyde homopolymer by weight and about 55% to about 75% of a furfuryl alcohol monomer by weight. Another example of a furan-based resin suitable for use in the methods of the present invention is a phenol/phenol formaldehyde/furfuryl alcohol resin comprising from about 5% to about 30% phenol by weight, from about 40% to about 70% phenol formaldehyde by weight, from about 10% to about 40% furfuryl alcohol by weight.

According to one of the presently most preferred embodiment of the invention, the furan-based resin comprises: a furan-furfuraldehyde homopolymer and a furfuryl alcohol monomer, in which case preferably the furan-furfuraldehyde homopolymer is present in the furan-based resin in an amount in the range of from about 25% to about 45% by weight and preferably the furfuryl alcohol monomer is present in the furan-based resin in an amount in the range of from about 55% to about 75% by weight.

According to another of the presently most preferred embodiments of the invention, the furan-based resin comprises a phenol/phenol formaldehyde/furfuryl alcohol resin, in which case preferably the phenol is present in the furan-based resin in an amount in the range of from about 5% to about 30% by weight, preferably the phenol formaldehyde is present in the furan-based resin in an amount in the range of from about 40% to about 70% by weight, and preferably the furfuryl alcohol is present in the furan-based resin in an amount in the range of from about 10% to about 40% by weight.

A silane coupling agent may be used in the treatment fluid for use in the present invention, inter alia, to act as a mediator to help bond the furan-based resin to particulate surfaces of the subterranean formation. Preferably, the treatment fluid further comprises: a silane coupling agent. More preferably, the silane coupling agent is present in the treatment fluid in an amount sufficient to bond the curable resin to particulates in the formation. For example, the silane coupling agent is present in the treatment fluid in an amount in the range of from about 0.1% to about 5% by weight of the curable resin. For example, the silane coupling agent can comprise any one or more of the following: n-2-(aminoethyl)-3-aminopropyltrimethoxysilane, 3-glycidoxypropyltrimetho-xysilane, or n-beta-(aminoethyl)-gamma-aminopropyl trimethoxysilane.

Optionally, a ductility imparting agent may be present in the treatment fluids for use in the present invention, inter alia, to improve the furan-based resin's ability to endure changes in the subterranean environment (e.g., cyclic stresses that may occur during times when a well bore is placed on production after having been shut-in, and the like). Preferably, the treatment fluid further comprises a ductility imparting agent. More preferably, the ductility imparting agent comprises phthalate. Examples of suitable ductility imparting agents include, but are not limited to, phthalate materials. In certain exemplary embodiments, the phthalate materials may relax the crosslinking in the cured furan-based resin. For example, the ductility imparting agent can comprise any one or more of the following: diethyl phthalate, butyl benzyl phthalate, and di-(2-ethylhexyl)phthalate. Preferably, the ductility imparting agent is present in the treatment fluid in an amount in the range of from about 0.1% to about 10% by weight of the curable resin.

Optionally, a diluent or liquid carrier fluid may be present in the treatment fluids of the present invention, inter alia, to reduce the viscosity of the treatment fluid for ease of handling, mixing and transferring. Preferably, the treatment fluid further comprises: a diluent for the curable resin in an effective concentration to reduce the viscosity of the curable resin so that it can flow into the near-wellbore region. More preferably, the diluent has a flash point above about 125° F. (52° C.). For example, the diluent can be selected from the group consisting of any one or more of the following: 2-butoxy ethanol, butyl acetate, furfuryl acetate. Further, the diluent can be present in the treatment fluid in an amount in the range of from about 1% to about 200% by weight of the curable resin.

It is within the ability of one skilled in the art, with the benefit of this disclosure, to determine if and how much diluent is needed to achieve a viscosity suitable to a particular subterranean environment. According to the preferred embodiment, any suitable diluent that is compatible with the furan-based resin and achieves the desired viscosity effects is suitable for use in the present invention.

Optionally, a surfactant may be present in the treatment fluids for use in the present invention. Preferably, the treatment fluid further comprises: a surfactant, wherein the surfactant is capable of oil-wetting silica. A wide variety of surfactants may be used, including, but not limited to, ethoxylated nonyl phenol phosphate esters, mixtures of one or more cationic surfactants, and one or more non-ionic surfactants and alkyl phosphonate surfactants. In the case of the alkyl phosphonate, preferably the alkyl phosphonate is a $C_{12}$-$C_{22}$ alkyl phosphonate. Preferably, the surfactant is present in the treatment fluid in an amount in the range of from about 0% to about 15% by weight of the curable resin. The mixtures of one or more cationic and nonionic surfactants suitable for use in the present invention are described in U.S. Pat. No. 6,311,773, the relevant disclosure of which is incorporated herein by reference.

The interval of the near-wellbore region is treated with preflush fluids, inter alia, to help remove oil residues and fines from sand pore spaces and enhance coating of the furan based resin onto the substrate surface of the formation sand. The preflush fluids comprise a mutual solvent and an aqueous fluid containing a surfactant, wherein the surfactant is capable of oil-wetting silica. The preflush fluids can be injected simultaneously or mixed together, but more preferably the mutual solvent and aqueous preflush fluids are injected separately. Most preferably, the mutual solvent preflush fluid is injected prior to the aqueous preflush fluid. A mutual solvent is a solvent capable of dissolving both water and residual oil. The aqueous preflush fluid preferably comprises an aqueous brine and the surfactant preferably comprises a cationic surfactant.

The method preferably further comprises the step of: injecting a postflush fluid into the near-wellbore region, wherein the postflush fluid comprises a surfactant, and wherein the surfactant is capable of oil-wetting silica. For example, the postflush fluid preferably comprises: an aqueous brine and the surfactant preferably comprises a cationic surfactant.

According to the invention, the method is particularly useful where a static temperature of a hydrocarbon-bearing reservoir of the near-wellbore region is less than 250° F. (120° C.). This is usually the case where steam flooding is used to heat the static temperature of the hydrocarbon-bearing reservoir to help drive heavy hydrocarbon through the reservoir to a production wellbore. However, the curable resin will not cure at such low temperatures unless heated or without the use of a curing agent. Even if a curing agent is employed, however, heating can be important to help the rate of curing. Preferably, the treatment fluid, when injected, is homogeneous and at a temperature below 212° F. (100° C.). This helps avoid premature curing of the resin before it can be placed or before excess resin can be flushed away in the near-wellbore region of the formation. More preferably, the treatment fluid is formulated at about ambient temperature at the wellhead, typically at a temperature below 150° F. (65° C.), whereby no heating is required during the step of forming the treatment fluid.

According to one embodiment of the invention wherein the static temperature of a hydrocarbon-bearing reservoir of the near-wellbore region is low, the breakthrough of the steam is employed to substantially increase the temperature of the near-wellbore region, which increases the rate at which the curable resin cures in the near-wellbore region. Preferably, the temperature is raised sufficiently that the curable resin substantially cures within about 6 hours to about 72 hours of the steam breaking through the near-wellbore region.

According to a further aspect of the invention wherein the static temperature of a hydrocarbon-bearing reservoir of the near-wellbore region is low, the treatment fluid further comprises a curing agent, wherein the curing agent is capable of substantially increasing the rate at which the curable resin cures at a temperature of less than 250° F. (120° C.). Preferably, the curable resin is permitted to cure in the near-wellbore region for a period in the range of from about 6 hours to about 72 hours prior to the step of driving steam through the near wellbore region.

According to one embodiment of the invention wherein the treatment fluid includes a curing agent, the curing agent comprises an acid. Preferably, the acid comprises: maleic acid, fumaric acid, sodium bisulfate, phosphoric acid, sulfonic acid, an alkyl benzene sulfonic acid such as toluene sulfonic acid and dodecyl benzene sulfonic acid, or a mixture of any of the foregoing. Preferably, the curing agent is present in the treatment fluid in an amount in the range of from about 0.01% to about 10% by weight of the furan-based resin. In certain exemplary embodiments, the curing agent may be present in the treatment fluid in an amount in the range of from about 1% to about 3% by weight of the curable resin.

According to another embodiment of the invention wherein the treatment fluid includes a curing agent, the curing agent comprises a delay release curing agent. Preferably, the delay release curing agent comprises a block acid. Examples of block acids include hydrolyzable esters, phosphoric acid, p-toluenesulfonic acid, dodecylbenzenesulfonic acid, dinonylnaphthalenesulfonic acid, and dinonylnaphthalenedisulfonic acid.

According to yet another aspect of the invention wherein the static temperature of a hydrocarbon-bearing reservoir of the near-wellbore region is low, the invention further comprises the step of: injecting an overflush fluid into the near-wellbore region after injecting the treatment fluid, wherein the overflush fluid comprises a curing agent, and wherein the curing agent is capable of substantially increasing the rate at which the curable resin cures at a temperature of less than 250° F. (120° C.). Preferably, the curable resin is permitted to cure in the near-wellbore region for a period in the range of from about 6 hours to about 72 hours prior to the step of driving steam through the near wellbore region. Preferably, the curing agent comprises an acid. When an overflush fluid is used, the method further preferably comprises the step of: injecting a spacer fluid into the near-wellbore region. This helps prevent premature mixing of the treatment fluid with the overflush fluid.

The method of the invention preferably further comprises the step of: isolating a selected portion of the wellbore. The selected portion of the wellbore to be treated may be isolated, for example, by placing a packer within a well bore in the formation, at a location above and/or below the interval. Preferably, the step of isolating a selected portion of the wellbore is performed prior to the step of injecting the treatment fluid, whereby the treatment fluid is directed into the near-wellbore region adjacent the selected portion of the wellbore.

Preferably, the treatment fluid is then injected into the subterranean formation at the desired selected portion of the wellbore, after which excess resin may be displaced out of the well bore. The interval is then preferably shut in for a sufficient period to allow the treatment fluid to cure to a desired level of strength, thereby transforming the treated interval within the formation into a substantially impermeable barrier. In certain exemplary embodiments of the present invention, the interval may be shut in for a time in the range of from about 6 hours to about 72 hours, during which the treatment fluid may cure. The time will depend on factors such as, inter alia, the composition of the curable resin, the temperature of the interval in the subterranean formation, and the level of strength desired from the treatment fluid after it cures. One of ordinary skill in the art, with the benefit of this disclosure, will be able to identify the proper time for curing of the treatment fluid for a particular application.

According to a further aspect of the invention, the method further comprises the steps of: (A) installing a sand control screen in the wellbore adjacent the formation wall or casing of the near-wellbore region; and (B) gravel packing an annular space between the sand control screen and the formation wall or casing.

According to one embodiment of installing a sand control screen and gravel packing, preferably the gravel comprises: a steam-resistant gravel. More preferably, the steam-resistant gravel comprises garnet.

According to another embodiment of installing a sand control screen and gravel packing, preferably at least some of the gravel used in the step of gravel packing is pre-coated with a cured resin system that is stable up to at least 350° F. (177° C.).

Preferably, the step of gravel packing is performed prior to the step of injecting the treatment fluid. Accordingly, the step of injecting the treatment fluid into the near-wellbore region further comprises the step of injecting the treatment fluid into the gravel pack.

According to another embodiment, however, the step of gravel packing can be performed after the curable resin has substantially cured in the near-wellbore region.

According to a still further aspect of the invention, the method further comprises the step of: installing an expandable screen in the wellbore adjacent the formation wall or inner wall of the casing. Preferably, the step of installing an expandable screen is performed prior to the step of injecting the treatment fluid. According to another embodiment, however, the step of installing an expandable screen can be performed after the curable resin has substantially cured in the near-wellbore region.

According to yet another aspect of the invention, the method further comprises the steps of: (A) installing a perforated liner or shroud in the wellbore adjacent the near-wellbore region; (B) isolating the annulus between the perforated liner or shroud and isolating a downhole end of the wellbore adjacent the near-wellbore region from an uphole end; (C) injecting a gravel packing fluid into the downhole end of the wellbore through the perforated liner, whereby the gravel is packed into the annulus and inside the perforated line or shroud, wherein the gravel packing fluid comprises a gravel suitable for gravel packing the annulus, and wherein the gravel is pre-coated with a curable resin; (D) allowing or causing the curable resin to cure, whereby the gravel pack is formed into a hard, permeable mass of gravel in the annulus and in the interior of the perforated liner or shroud; and (E) drilling at least a portion of the hard, permeable mass of gravel out of the interior of the perforated liner or shroud.

According to one embodiment of installing a perforated liner or shroud and gravel packing, preferably the gravel comprises a steam-resistant gravel. More preferably, the steam-resistant gravel comprises garnet.

According to another embodiment of installing a perforated liner or shroud and gravel packing, preferably at least some of the gravel used in the step of gravel packing is pre-coated with a cured resin system that is stable up to at least 350° F. (177° C.).

The step of allowing or causing the curable resin composition pre-coated on the gravel to harden preferably comprises overflushing the gravel pack with a curing agent for causing the curable resin to cure.

According to a preferred embodiment, the step of allowing or causing the curable resin composition pre-coated on the gravel to harden into a hard, permeable mass is performed prior to the step of injecting the treatment fluid. According to another embodiment, however, the step of installing a perforated liner or shroud can be performed after the step of injecting a treatment fluid.

According to one embodiment of the invention, the step of driving steam can further comprise injecting the steam through a separate wellbore remote from the treated near-wellbore region, whereby the steam is driven through a far-wellbore region into the treated near-wellbore region. In this case, the separate wellbore can be of a separate, remote injection well, whereby the steam is driven through a far-wellbore region to the treated near-wellbore region. The more remote the wellbore into which the steam is injected, however, the longer the time it will take to reach the treated near-wellbore region of a production wellbore. Further, the steam will tend to first drive heavy oil through the near-wellbore region of the production wellbore before the steam breaks through. In such a situation, however, it is important for the resin to substantially cure before the steam breakthrough, otherwise the heavy oil production will tend to produce particulate fines and sand through a poorly consolidated near-wellbore region. In such a situation, the curable resin is preferably allowed or caused to cure in the near-wellbore region before any steam breakthrough of the near-wellbore region.

According to another embodiment of the invention, the step of driving steam can be further comprise: injecting the steam through a portion of the wellbore that is remote from the treated near-wellbore region, whereby the steam is driven through a far-wellbore region to the treated near-wellbore region.

According to yet another embodiment of the invention, the step of driving steam can further comprise: injecting steam through the portion of the wellbore adjacent the near-wellbore region and directly to the treated near-wellbore region.

Preferably, the steam driven through the near-wellbore region is at a temperature greater than 250° F. (120° C.).

EXAMPLE 1

According to one example embodiment according to the invention, the method comprises the steps of:

1. Isolating a zone of interest;
2. Installing at least one sand control screen;
3. Gravel packing the annulus between the screen and formation wall or casing. It is optional to coat the gravel with high temperature, curable resin, preferably a furan based resin system which is suitable to handle temperatures above 350° F. (177° C.).
4. Performing a resin consolidation treatment on the gravel pack in the annulus and at least the near-wellbore region of the formation surrounding the wellbore. This treatment comprises of:
   a) injecting a mutual solvent preflush fluid capable of dissolving residual oil;
   b) injecting an aqueous preflush fluid further comprising a surfactant to help oil-wet the sand surface so that the resin can preferentially coat onto the sand;
   c) injecting a low-viscosity furan/furfuryl alcohol resin into gravel pack and into the formation surrounding the wellbore;
   d) injecting a spacer fluid to separate and prevent the contact between the furan resin and the catalyst to be followed inside the wellbore as they are being pumped downhole;
   e) injecting an overflush fluid containing a catalyst to displace the excess resin occupying the pore spaces in the gravel pack and the formation matrix and to help restore their permeability.

The function of the catalyst is to activate the polymerization and curing of the furan/furfuryl alcohol resin when the static reservoir temperature and bottom hole temperature are both less than 250° F. (120° C.). The coating of furan/furfuryl alcohol resin helps protect the gravel pack from being destroyed or dissolved while providing consolidation to both gravel pack and formation sand to keep them in place during production, even while under steam breakthrough.

It should be noted that before the steam breakthrough, the static reservoir temperature of the near-wellbore region is low. This is main reason why the use of furan/furfuryl alcohol resin and external catalyst to facilitate the curing of the resin at low temperature is desirable so as to provide a means to be able to protect the gravel and to remain stable while being exposed to steam breakthrough. The resin consolidation treatment of the invention helps transform the weakly or unconsolidated formation into a more highly consolidated, yet permeable masses. The resin consolidation treatment protects the treated formation and remains stable while being exposed to high temperatures of a steam breakthrough. By stabilizing the formation, formation sand, and fines remain at the source without migrating or producing out with the production fluid. This helps prevent erosion of a well screen positioned in the well bore caused by steam treatments that otherwise dissolve the formation silica surrounding the wellbore and carry fines, which erodes the well screen.

In another embodiment, the order of operation can be reversed wherein the resin treatment is first performed prior to the gravel pack operation.

EXAMPLE 2

In another example according to the invention, the method comprises the steps of:

1. Isolating a zone of interest;
2. Performing a resin consolidation treatment on the near-wellbore region surrounding the wellbore. This treatment comprises of:
   a) injecting a mutual solvent preflush fluid capable of dissolving oil to help remove residual oil;
   b) injecting an aqueous preflush fluid further comprising a surfactant to help oil-wet the sand surface so that the resin can preferentially coat onto the sand surface;
   c) injecting a low-viscosity furan/furfuryl alcohol resin into any gravel pack and at least the near-wellbore region surrounding the wellbore;
   d) injecting a spacer fluid to separate and prevent the contact between the furan resin and the catalyst to be followed inside the wellbore as they are being pumped downhole;
   e) injecting an overflush fluid containing a catalyst to displace the excess resin occupying the pore spaces in the gravel pack and the formation matrix and to help restore their permeability.
3. Installing at least one perforated liner or shroud;
4. Isolating the annulus between the perforated liner and lower end of wellbore in the zone from an uphole end;
5. Injecting a curable resin composition pre-coated gravel into lower end of wellbore in zone by way of perforated liner whereby particulate material is uniformly packed into the annulus and into the slotted liner;
6. Causing the curable resin composition to harden whereby the gravel is consolidated into a hard permeable uniform mass capable of preventing migration of at least a portion of any unconsolidated formation fines and sand with fluids produced into the wellbore from the zone; and
7. Drilling at least a portion of the hard permeable mass of particulate material formed in accordance with step (6) out of the interior of the perforated liner.

EXAMPLE 3

In yet another embodiment according to the invention, the gravel pack treatment is replaced with the installation and expansion of expandable sand screens. The expandable screen is expanded against the formation wall. The resin treatment (including preflush, treatment of low viscosity furan/furfuryl alcohol resin, spacer, and overflush) is performed by injecting the fluids at least into the near-wellbore region of the formation surrounding the wellbore through the expanded screen. This resin treatment helps transform the weakly or unconsolidated formation and gravel pack into highly consolidated, yet permeable masses. By stabilizing the near-wellbore region, formation sand and fines will remain at their source without migrating or producing out with the production fluid that would gradually plug up the expanded screen.

Therefore, the present invention is well adapted to carry out the objects and attain the ends and advantages mentioned as well as those that are inherent therein. While those skilled in the art may make numerous changes, such changes are encompassed within the spirit of this invention as defined by the appended claims.

What is claimed is:

1. A method of steam flooding for stimulating hydrocarbon production, the method comprising the steps of:

(A) injecting a mutual solvent preflush fluid capable of dissolving oil into the near-wellbore region of at least a portion of a wellbore;

(B) injecting an aqueous preflush fluid into the near-wellbore region, wherin the aqueous fluid further comprises a surfactant capable of oil-wetting silica;

(C) injecting a treatment fluid into the near-wellbore region, (i) wherein the treatment fluid comprises a curable resin, and wherein: (a) when injected, the curable resin is in an uncured state; and (b) after being cured, the curable resin is stable up to at least 350° F. (177° C.); and (D) driving steam to break through the near-wellbore region.

2. The method according to claim 1, wherein the curable resin comprises: a furan based resin.

3. The method according to claim 1, wherein the treatment fluid further comprises: a silane coupling agent.

4. The method according to claim 1, wherein the treatment fluid further comprises a ductility imparting agent.

5. The method according to claim 1, wherein the treatment fluid further comprises: a diluent for the curable resin in an effective concentration to reduce the viscosity of the curable resin so that it can flow into the near-wellbore region.

6. The method according to claim 1, wherein the treatment fluid further comprises: a surfactant, and wherein the surfactant is capable of oil-wetting silica.

7. The method according to claim 1, wherein the treatment fluid, when injected, is homogeneous and at a temperature below 212° F. (100° C.).

8. The method according to claim 1, further comprising the step of: injecting a postflush fluid into the near-wellbore region, wherein the postflush fluid comprises a surfactant, and wherein the surfactant is capable of oil-wetting silica.

9. The method according to claim 1, wherein the static temperature of a hydrocarbon-bearing reservoir of the near-wellbore region is less than 250° F. (120° C.).

10. The method according to claim 9, wherein the breakthrough of steam substantially cures the curable resin within about 6 hours to about 72 hours of the steam breaking through the near-wellbore region.

11. The method according to claim 9, wherein the treatment fluid further comprises a curing agent, wherein the curing agent is capable of substantially increasing the rate at which the curable resin cures at a temperature of less than 250° F. (120° C.).

12. The method according to claim 11, wherein the curing agent comprises a delay release curing agent.

13. The method according to claim 12, wherein the delay release curing agent comprises a block acid.

14. The method according to claim 9, further comprising the step of: injecting an overflush fluid into the near-wellbore region after injecting the treatment fluid, wherein the overflush fluid comprises a curing agent, and wherein the curing agent is capable of substantially increasing the rate at which the curable resin cures at a temperature of less than 250° F. (120° C.).

15. The method according to claim 14, wherein the curing agent comprises an acid.

16. The method according to claim 14, further comprising the step of: injecting a spacer fluid into the near-wellbore region between the step of injecting the treatment fluid and the step of injecting the overflush fluid.

17. The method according to claim 1, further comprising the step of: isolating a selected portion of the wellbore prior to the step of injecting the treatment fluid, whereby the treatment fluid is directed into the near-wellbore region adjacent the selected portion of the wellbore.

18. The method according to claim 1, further comprising the steps of:

(A) installing a sand control screen in the wellbore adjacent the adjacent the formation wall or casing of the near-wellbore region; and (B) gravel packing an annular space between the sand control screen and the and the formation wall or casing.

19. The method according to claim 1, further comprising the step of: installing an expandable screen in the wellbore adjacent the adjacent the formation wall or casing of the near-wellbore region.

20. The method according to claim 1, further comprising the steps of:

(A) installing a perforated liner or shroud in the wellbore adjacent the adjacent the formation wall or casing of the near-wellbore region;

(B) isolating the annulus between the perforated liner or shroud and isolating a downhole end of the wellbore adjacent the near-wellbore region from an uphole end;

(C) injecting a gravel packing fluid into the downhole end of the wellbore through the perforated liner, whereby the gravel is packed into the annulus and inside the perforated line or shroud, wherein the gravel packing fluid comprises a gravel suitable for gravel packing the annulus, and wherein the gravel is pre-coated with a curable resin;

(D) allowing or causing the curable resin pre-coated on the gravel to cure, whereby the gravel pack is formed into a hard, permeable mass of gravel in the annulus and in the interior of the perforated liner or shroud; and (E) drilling at least a portion of the hard, permeable mass of gravel out of the interior of the perforated liner or shroud.

21. The method according to claim 20, wherein (i) when injected, the curable resin pre-coated on the gravel is in an uncured state; and (ii) after being cured, the curable resin pre-coated on the gravel is stable up to at least 350° F. (177° C.).

22. The method according to claim 1, wherein the step of driving steam further comprises: injecting the steam through a separate wellbore remote from the treated near-wellbore region, whereby the steam is driven through a far-wellbore region into the treated near-wellbore region.

23. The method according to claim 1, wherein the step of driving steam further comprises: injecting the steam through a portion of the wellbore that is remote from the treated near-wellbore region, whereby the steam is driven through a far-wellbore region to the treated near-wellbore region.

24. The method according to claim 23, wherein the curable resin is allowed or caused to cure in the near-wellbore region before any steam breakthrough of the near-wellbore region.

25. The method according to claim 1, wherein the step of driving steam further comprises: injecting steam through the portion of the wellbore adjacent the near-wellbore region and directly to the treated near-wellbore region.

26. A method of steam flooding for stimulating hydrocarbon production, the method comprising the steps of:

(A) injecting a mutual solvent preflush fluid capable of dissolving oil into the near-wellbore region of at least a portion of a wellbore;

(B) injecting an aqueous preflush fluid further comprising a surfactant capable of oil-wetting silica;

(C) injecting a treatment fluid into the near-wellbore region of a production well, (i) wherein the treatment fluid comprises a curable resin, wherein the curable resin comprises: a furan based resin, wherein: (a) when injected, the curable resin is in an uncured state; and (b) after being cured, the curable resin is stable up to at least 350° F. (177° C.), (ii) wherein the static temperature of a hydrocarbon-bearing reservoir adjacent the near-wellbore region is less than 250° F. (120° C.);

(D) allowing the curable resin to substantially cure in the near-wellbore region; and (E) driving steam from a remote injection well to break through the near-wellbore region only after the resin has substantially cured to help consolidate the near-wellbore region.

27. The method according to claim 26, wherein the treatment fluid, when injected, is homogeneous and at a temperature below 212° F. (100° C.).

* * * * *